US006890185B1

(12) United States Patent
Kister et al.

(10) Patent No.: US 6,890,185 B1
(45) Date of Patent: May 10, 2005

(54) MULTIPATH INTERCONNECT WITH MEANDERING CONTACT CANTILEVERS

(75) Inventors: January Kister, Portola Valley, CA (US); James Jaquette, Mesa, AZ (US); Steve Fahrner, Chandler, AZ (US)

(73) Assignee: Kulicke & Soffa Interconnect, Inc., Wilmington, DE (US)

( * ) Notice: Subject to any disclaimer, the term of this patent is extended or adjusted under 35 U.S.C. 154(b) by 37 days.

(21) Appl. No.: 10/700,401

(22) Filed: Nov. 3, 2003

(51) Int. Cl.[7] ..... H01R 9/09
(52) U.S. Cl. ..... 439/66
(58) Field of Search ..... 439/66, 71, 70, 439/81, 67; 361/767, 60

(56) References Cited

U.S. PATENT DOCUMENTS

| | | | | | |
|---|---|---|---|---|---|
| 5,015,191 | A | | 5/1991 | Grabbe et al. | 439/71 |
| 5,139,427 | A | * | 8/1992 | Boyd et al. | 439/66 |
| 5,152,695 | A | | 10/1992 | Grabbe et al. | 439/71 |
| 5,173,055 | A | | 12/1992 | Grabbe et al. | 439/66 |
| 5,228,861 | A | | 7/1993 | Grabbe | 439/66 |
| 5,380,210 | A | * | 1/1995 | Grabbe et al. | 439/66 |
| 5,462,440 | A | * | 10/1995 | Rothenberger | 439/66 |
| 5,529,504 | A | * | 6/1996 | Greenstein et al. | 439/91 |
| 5,629,837 | A | | 5/1997 | Barabi et al. | 361/767 |
| 5,810,609 | A | * | 9/1998 | Faraci et al. | 439/71 |
| 5,934,914 | A | * | 8/1999 | Fjelstad et al. | 439/82 |
| 5,984,691 | A | * | 11/1999 | Brodsky et al. | 439/66 |
| 6,029,344 | A | | 2/2000 | Khandros et al. | 29/874 |
| 6,042,387 | A | | 3/2000 | Jonaidi | 439/66 |
| 6,286,205 | B1 | * | 9/2001 | Faraci et al. | 29/837 |
| 6,328,573 | B1 | * | 12/2001 | Sakata et al. | 439/66 |
| 6,338,629 | B1 | * | 1/2002 | Fisher et al. | 439/66 |
| 6,375,474 | B1 | * | 4/2002 | Harper et al. | 439/66 |
| 6,402,526 | B1 | | 6/2002 | Schreiber et al. | 439/67 |
| 6,442,039 | B1 | | 8/2002 | Schreiber | 361/60 |
| 6,532,654 | B2 | * | 3/2003 | Guerin et al. | 29/884 |
| 6,604,950 | B2 | * | 8/2003 | Maldonado et al. | 439/66 |
| 6,627,092 | B2 | * | 9/2003 | Clements et al. | 216/13 |
| 6,632,733 | B2 | * | 10/2003 | Mohammed | 438/614 |
| 6,708,399 | B2 | * | 3/2004 | Farnworth et al. | 29/830 |
| 6,775,906 | B1 | * | 8/2004 | Silverbrook | 29/846 |
| 2003/0060061 | A1 | | 3/2003 | Gonzalez et al. | 439/66 |

* cited by examiner

*Primary Examiner*—Ross Gushi
*Assistant Examiner*—Phuongchi Nguyen
(74) *Attorney, Agent, or Firm*—RatnerPrestia

(57) ABSTRACT

An interconnect assembly includes a number of interconnect stages combined in a carrier structure. Each interconnect stage includes at least two contact sets having an upwards pointing cantilever contact and a downwards pointing cantilever contact. The cantilever contacts are attached to the carrier structure and are arranged around openings in the carrier structure such that the downward pointing cantilevers may reach through the carrier structure. Each contact set defines an independent conductive path between a single pair of opposing chip and test apparatus contacts such that multiple conductive paths are available for each interconnect stage for increased transmission reliability and reduced resistance. The cantilever contacts have a meandering contour and are either combined in symmetrical pairs at their respective tips or are free pivoting. The meandering contour provides a maximum deflectable cantilever length within an available footprint defined by the pitch of the tested chip.

50 Claims, 18 Drawing Sheets

MULTIPATH INTERCONNECT WITH MEANDERING CONTACT CANTILEVERS

FIELD OF INVENTION

The present invention relates to interconnect assemblies for repetitively establishing conductive contact between opposing contact arrays. Particularly, the present invention relates to interconnect assemblies having a number of arrayed interconnect stages including meandering cantilever contacts combined with a planar carrier structure.

BACKGROUND OF INVENTION

Demand for ever decreasing chip fabrication costs forces the industry to develop new solutions for inexpensive and reliable chip testing devices. A central component for repetitively contacting contact arrays of tested circuit chips is an interconnect assembly that is placed adjacent a test apparatus contact array that has contact pitch corresponding to the tested chips' carrier (package) contact pitch. During packaged chip testing, a package is brought with its contact array into contact with the interconnect assembly such that an independent conductive contact is established between each of the package's contacts and the corresponding contact of the test apparatus.

A first important aspect for reliable performance of a test apparatus is the interconnect assembly's ability to establish conductive contact with constant minimum electrical resistance to the tested chip over a maximum number of test cycles. For that purpose, multiple conductive paths are desirable between each pair of opposing contacts to level contact resistance fluctuations and to reduce the total transmission resistance of the interconnect stage.

In addition, eventual oxide and contaminant layers need to be removed by a scratching movement of the interconnect assembly's contact tips along the test contact surfaces. In addition, each of the assembly's interconnect stages needs to provide a maximum contacting flexibility to resiliently compensate for dimensional discrepancies of the tested contacts. The present invention addresses these needs.

A second aspect for reliable performance is minimum fatigue of the involved parts such that a constant contacting force is maintained for a maximum number of test cycles. Prone to fatigue in common interconnect assemblies are peak stress regions of repetitively elastically deformed interconnect members. Also commonly affected by fatigue failure is the connecting interface of the conductive structure with the non conductive carrier structure, which tends to delaminate as a result of repetitive high peak load changes in the interface. The present invention addresses these issues.

For a cost effective and reliable fabrication of interconnect assemblies there exists a need for a interconnect configuration that requires a minimum number of involved fabrication steps and individual components. Fabrication steps are preferably performed along a single axis. Assembling operations are preferably avoided. The present invention addresses this need.

SUMMARY OF THE INVENTION

An interconnect assembly includes a number of interconnect stages combined in a preferably planar carrier structure. Each interconnect stage includes at least two contact sets having an upwards pointing cantilever contact and a downwards pointing cantilever contact. The cantilever contacts are attached with a common base onto framing elements of the carrier structure. The framing elements are arranged around openings in the carrier structure such that the downward pointing cantilever contacts may reach through the carrier structure. Each contact set defines an independent conductive path between a single pair of opposing chip and test apparatus contacts such that multiple conductive paths are available for each interconnect stage to transmit electrical pulses and/or signals with increased reliability and reduced electrical resistance compared to prior art single path interconnect stages.

The cantilever contacts have a meandering contour and are either combined at their tips in symmetrical pairs or are free pivoting with released tips. The meandering contour provides a maximum deflectable cantilever length within an available footprint contributing to a maximum flexibility of each interconnect stage.

BRIEF DESCRIPTION OF THE FIGURES

The file of this patent contains FIGS. 12–18 executed in color. Copies of this patent with color drawings will be provided by the Patent and Trademark Office upon request and payment of the necessary fee.

DETAILED DESCRIPTION

Figure 1:
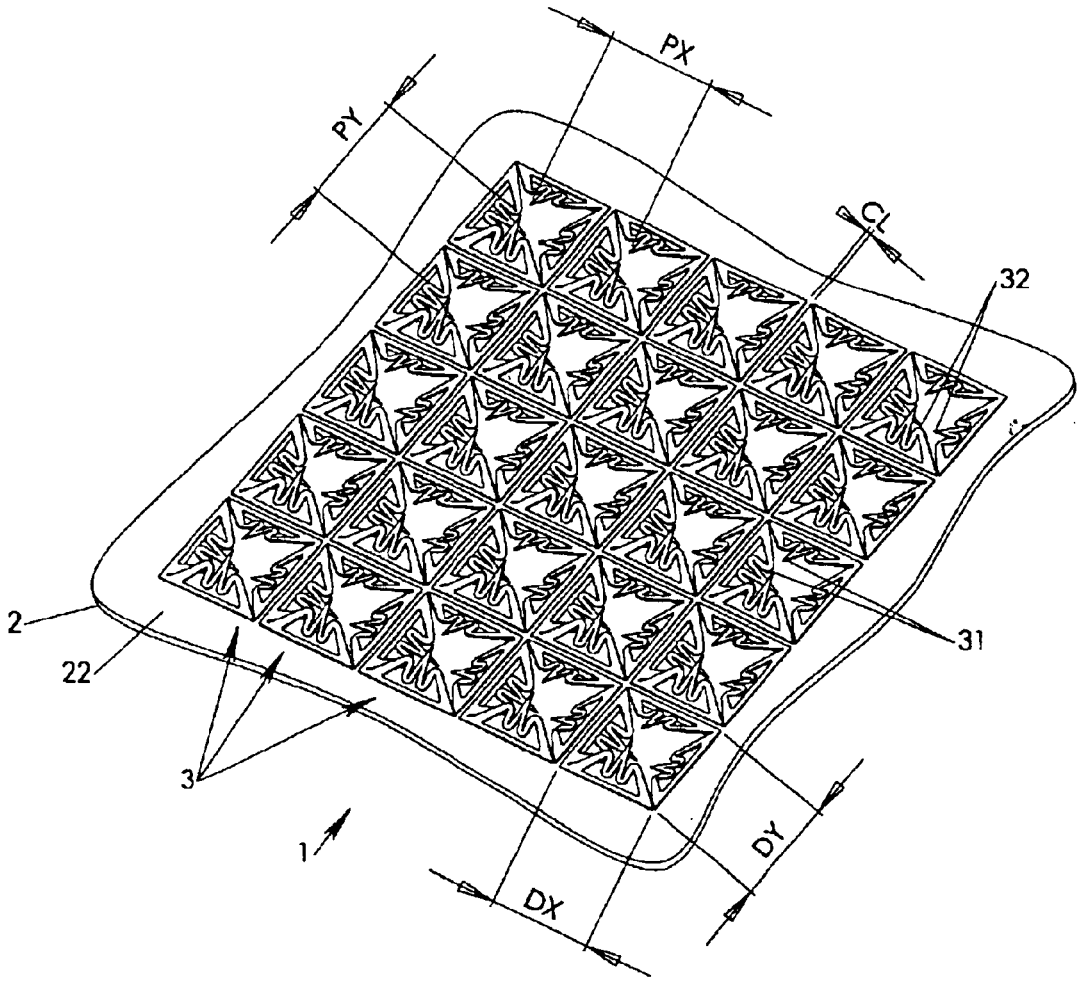
FIG. 1 is a perspective view of a portion of an interconnect assembly in accordance with a first embodiment of the present invention.
Figure 2:
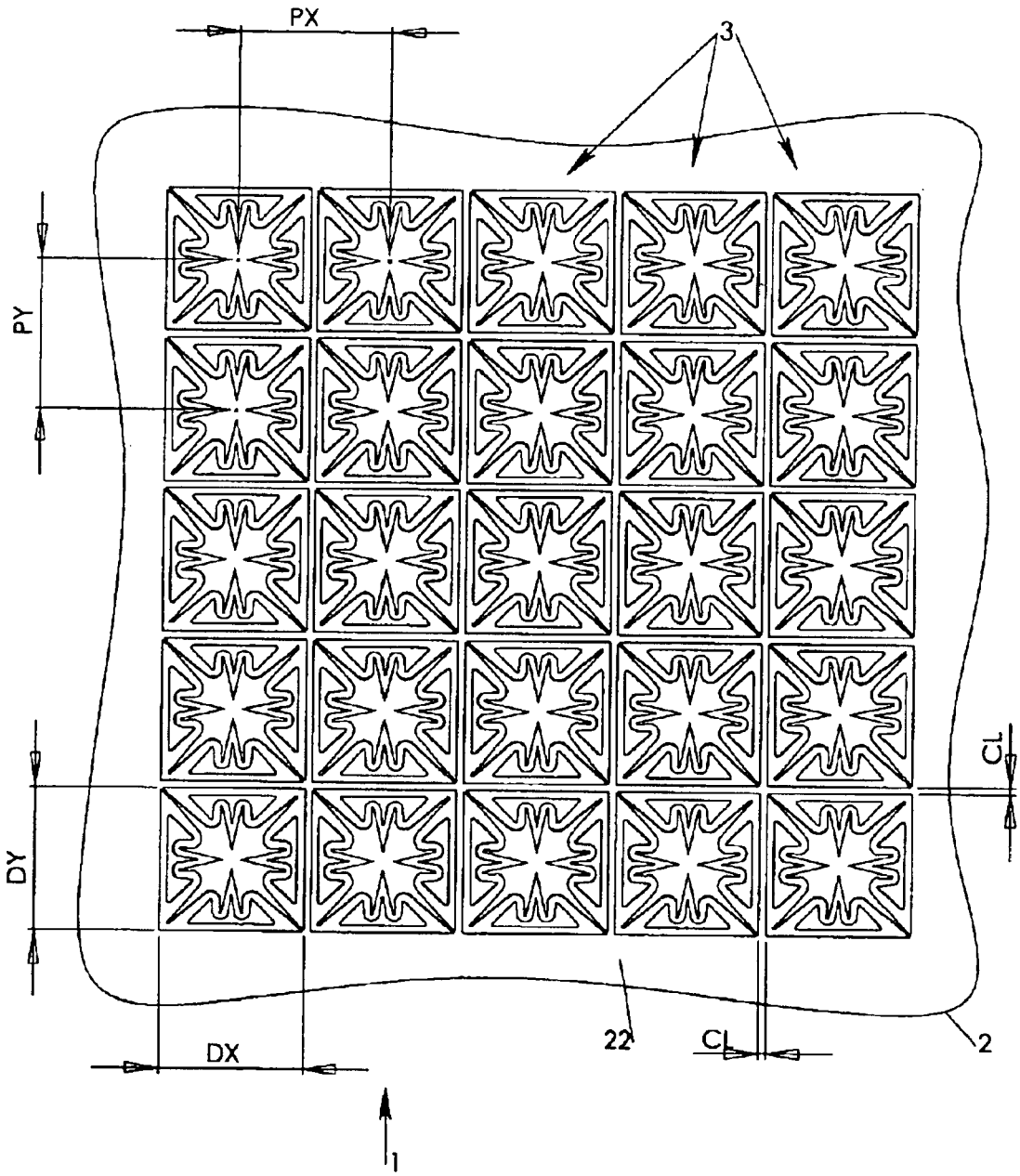
FIG. 2 illustrates a top view of the assembly portion of FIG. 1.
Figure 3:
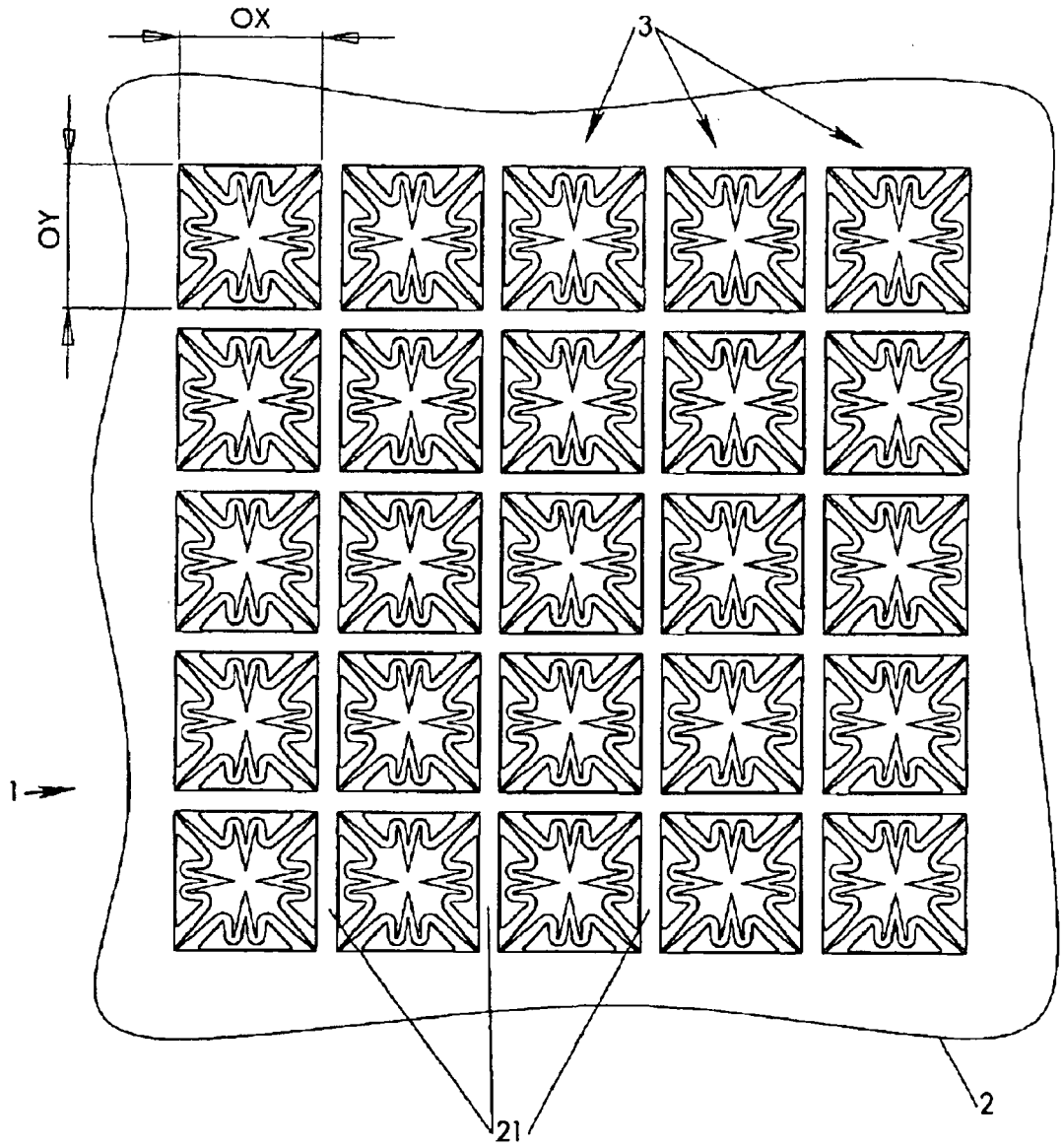
FIG. 3 depicts a bottom view of the assembly portion of FIG. 1.

According to FIGS. 1–3, an interconnect assembly 1 may include a carrier structure 2 made of a rigid, non conductive material such as PCB. The carrier structure 2 holds a number of interconnect stages 3 that are two dimensionally arrayed with pitches PX and PY. The pitches PX, PY are defined in conjunction with pitches of a tested circuit chip contacts as is well known in the art.

Preferably each but at least one of the interconnect stages 3 features at least two but preferably four upwards pointing meandering cantilever contacts 31 and at least two but preferably four downwards pointing meandering cantilever contacts 32. The interconnect stages 3 are attached at the top face 22 of the carrying structure 2. At this point it is noted that the terms "top, bottom, upwards, downwards" are introduced for the sole purpose of establishing relative directional relations between individual components rather than spatial position or orientations.

Figure 5:
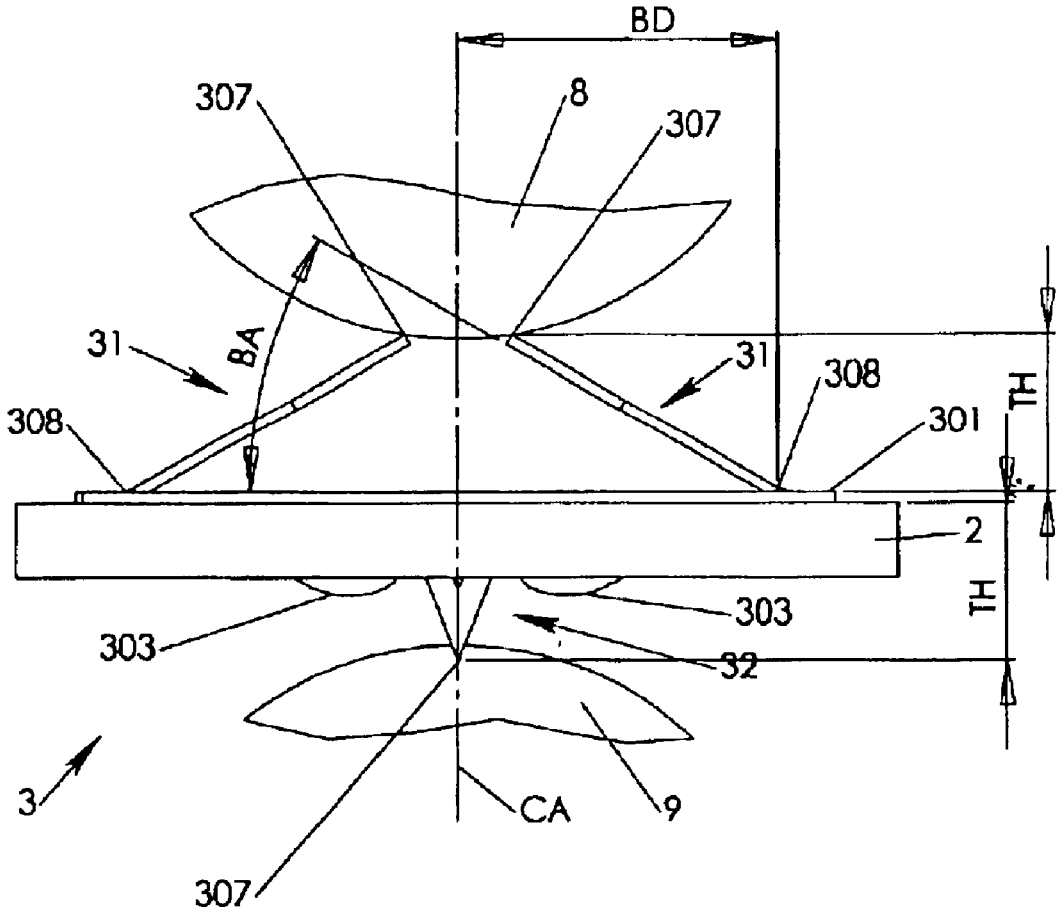
FIG. 5 is a side view of the interconnect stage of FIG. 4.

Preferably each but at least one of the interconnect stages 3 is configured for establishing multiple paths conductive contact between opposing contacts 8, 9 (see FIG. 5). The conductive contacts 8, 9 are preferably arrayed in a separate well known grid array. The contacts 8, 9 may have a spherical shape well known for so called ball grid arrays. One of the opposing contact arrays may be part of a tested circuit chip's package and the other of the opposing contact arrays may be part of a testing apparatus having its contact pitch adjusted to that of the tested circuit chip's package.

The interconnect stages 3 are positioned with a certain clearance CL to each other to provide electric insulation between adjacent interconnect stages 3. Thus, stage extensions DX, DY are the remainder of the Pitches PX, PY reduced by clearances CL between all adjacent interconnect stages 3.

The interconnect stages 3 are preferably shaped directly on the carrier structure by well known processes for fabrication millimeter scale and sub millimeter scale structures. Such processes may include electro deposition, electro plating, deep trench etching and the like. For these preferred fabrication cases, the stage extensions DX, DY define the overall real estate within which the meandering cantilevers 31, 32 are fabricated. The geometric shape of the real estate corresponds thereby to the array pattern of the tested chip's package and is preferably square but may have any geometrical shape as may be well appreciated by anyone skilled in the art.

The cantilever contacts 31, 32, 41, 42 (see also FIGS. 8–11) are preferably deposited in a planar shape on top of an initially solid carrier structure 2, 5 (see also FIGS. 8–11). In a following operation, openings of the carrier structure 2, 5 are fabricated in well known fashion and a bendable portion of the finally contoured cantilever contacts 31, 32, 41, 42 are partially released from the carrier structure 2. In a final fabrication step, the bendable portions including the cantilever contacts 31, 32, 41, 42 are bent along bending axes 308, 3082, 4082 (see also FIGS. 5–9). As shown in FIG. 3, openings are defined in the carrier structure 2 in between framing elements 21.

Figure 4:
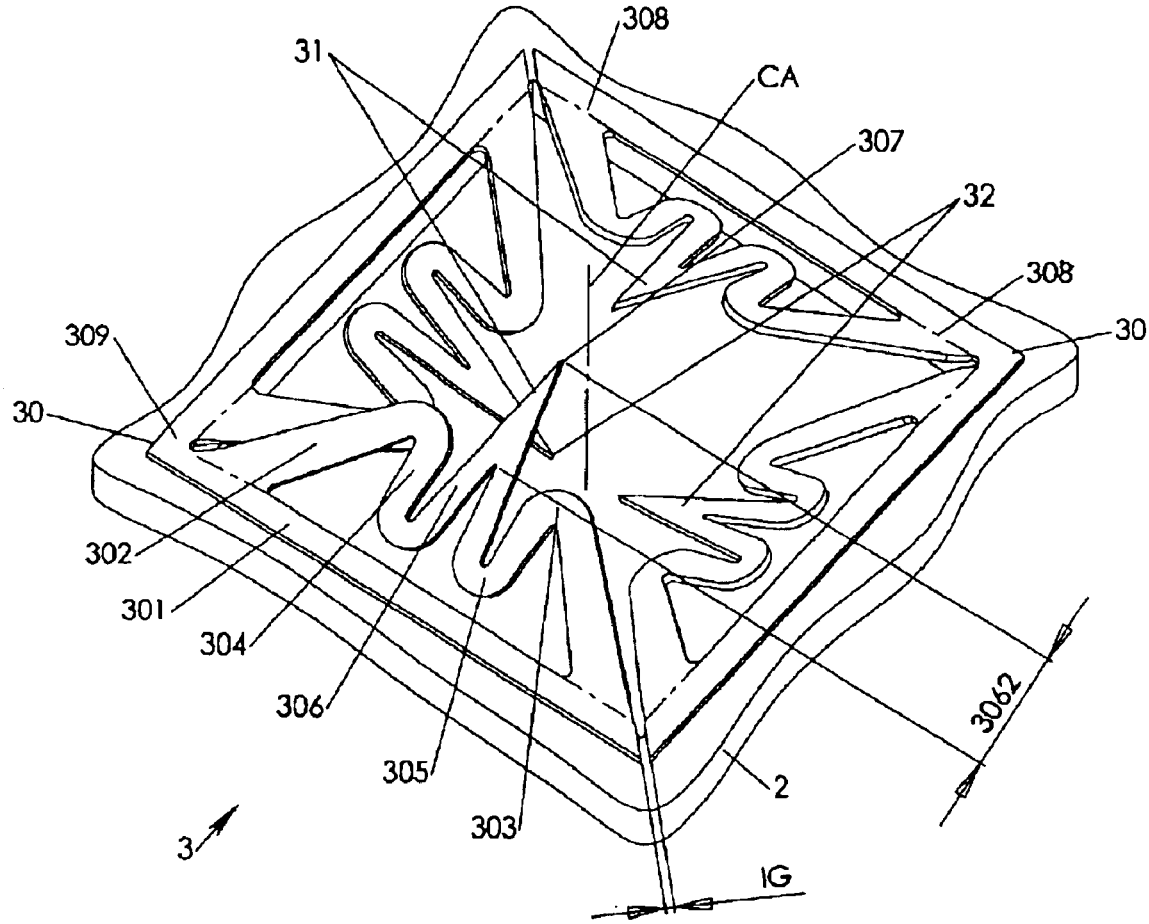
FIG. 4 shows a perspective view of an individual interconnect stage of the assembly portion of FIG. 1.

As depicted in FIG. 4, two upwards pointing cantilevers 31 are combined with two downwards pointing cantilever 32 in a contact set 30. Each of the cantilevers 31, 32 has a base 301 that is attached to the carrier structure 2. In the fabrication case described in the above paragraph, the base 301 is the non released portion of the initially planar deposited conductive structure. From the base 301 extend base beams 302 towards a contact tip 307. At the end of the base beam 302 that is close to the contact tip 307 is a reverting bow 303 from which a reverting beam 304 protrudes away from the contact tip 307. At the end of the reverting beam 304 that is distal to the contact tip 307 is a forward bow 305 from which again a tip beam 306 is extending towards and terminating in the contact tip 307. The base 301 is preferably the only non deflecting portion of the cantilevers 31, 32. All other components 302–307 deflect as a result of a contact 8, 9 being forced against the contact tips 307.

In the contact set 30, the two cantilevers 31 and the cantilevers 32 are mirrored representations of each other and combined along a beam connect 3062, which is preferably placed at the central end of the tip beams 306. The beam connect 3062 may be optionally employed for mutual lateral support of adjacent pairs of cantilevers 31, 32 with their respective bases 301 being connected as well for including all cantilevers 31, 32 for electrical current propagation.

After preferred initial planar fabrication and partial release of the deflectable portion, a bending operation may be employed to reorient at least one of the components 302–307 in direction parallel to the contacting axis CA. The bending operation is preferably applied along a bending axis 308 in closest proximity to the base 301. In that fashion and as illustrated in FIG. 5, a maximum tip height TH may be obtained for a given bending angle BA, where a bend axis distance BD is brought to a maximum. Since small bending angles BA are desired to minimize the risk of excessive plastic deformation in the bending region, the bending axis 308 is positioned preferably at a maximum bending axis distance BD.

The contacting axis CA is a geometric element introduced for the purpose of ease of understanding and generally describing the operational geometric conditions that exist for interconnect assemblies 3, 4. The preferred mode of interconnect assembly's 1 operation is with contacts 8, 9 approaching substantially perpendicular and in a centered fashion with respect to the planar layout of each interconnect stage 3 and the carrier structure 2 respectively reflected by the contacting axis CA. The scope of the invention includes embodiments in which the one or both contacts 8, 9 approach the interconnect stages 3, 4 other than perpendicular as long as they follow the breath of the teachings presented above and below as may be well appreciated by anyone skilled in the art.

The bending axes 308, 3082, 408, 4082 are introduced above and in the below as simplified descriptions of the angular deformation process induced to the cantilevers 31, 32, 41, 42 to spatially reorient their released portions. The angular deformation process may include any well known plastic forming steps including mechanical and/or thermal deformation. The bent region in the vicinity of the bending axes may have radiuses and other features commonly affiliated with these plastic forming steps. The bending axes 308, 3082, 408, 4082 may be interpreted as an axis around which to the majority of the released cantilever portion is substantially rotated during the plastic forming step(s). The scope of the invention includes embodiments, in which the released cantilever portions are three dimensionally shaped with multiple plastic forming operations. The scope of the invention includes also embodiments, in which the released cantilever portions are three dimensionally fabricated with well known 3 D shaping operations and without plastic forming operations.

Figure 6:
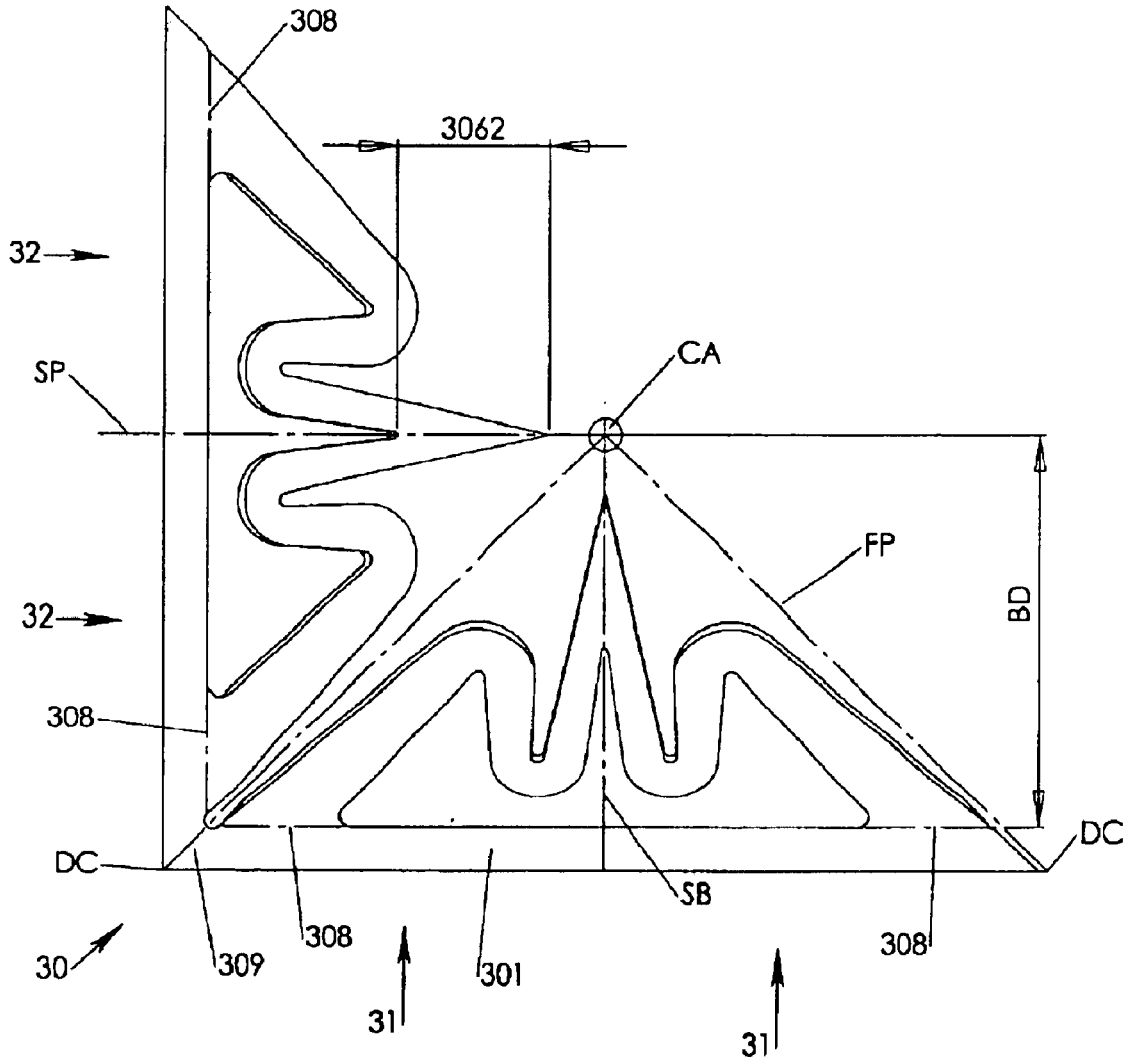
FIG. 6 depicts a top view of a contact set of the interconnect stage of FIG. 4.
Figure 7:
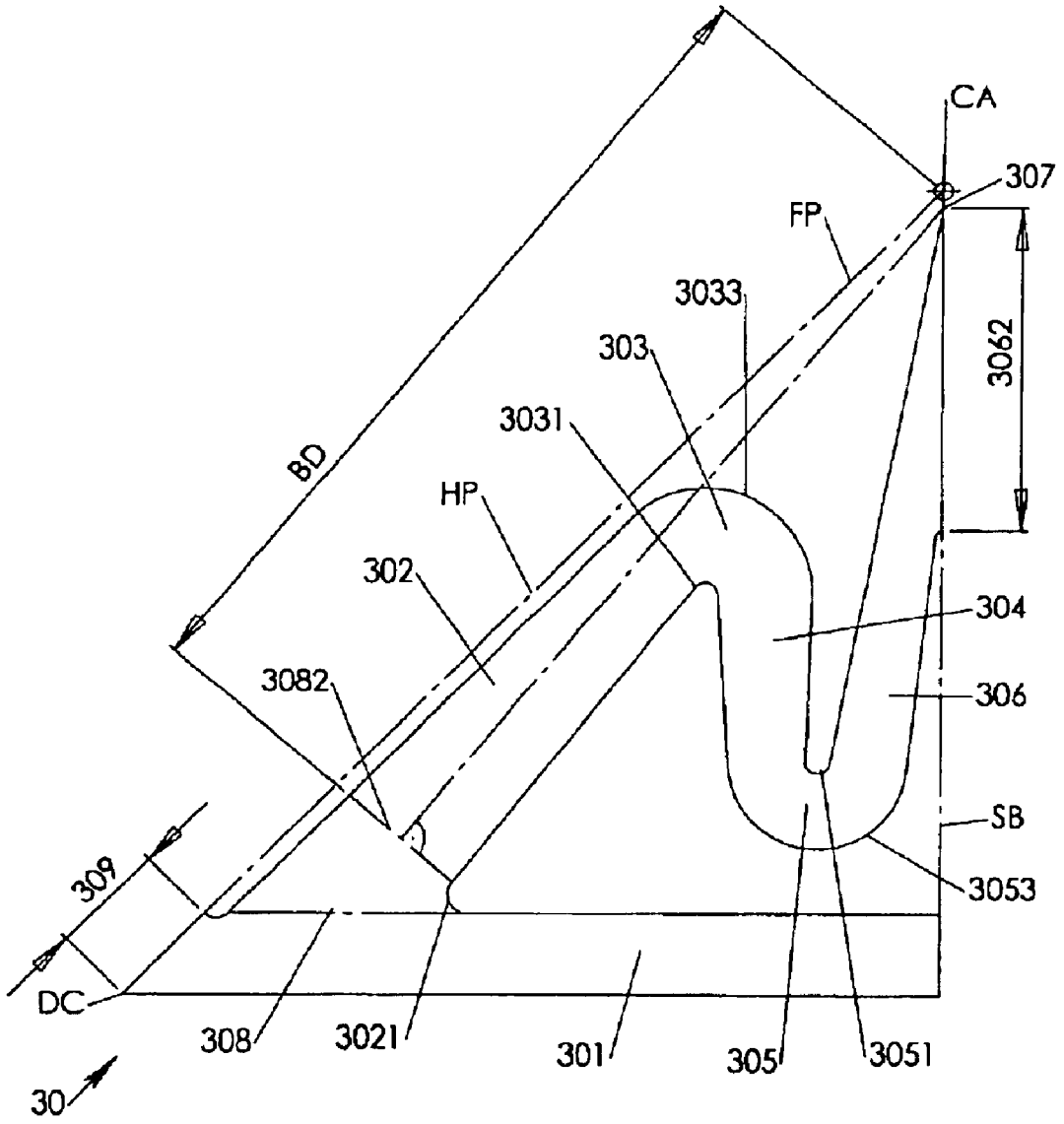
FIG. 7 illustrates a top view of a portion of the contact set of FIG. 6 including a single meander cantilever in flattened condition.

As illustrated in FIGS. 6 and 7, each of the cantilevers 31, 32 is fabricated within a triangular footprint FP having a center corner coinciding with the contacting axis CA, a symmetry boundary SB and a distal portion including a distal corner DC most distal to the contacting axis CA. The most distant corner DC is at the distal end of the longest boundary line of the foot print FP. In the case of squarely arrayed test contacts, the overall layout of the interconnect stages 3 is also in a square fashion and the maximum available real estate is consequently square as well. Where in that case a total of eight cantilevers 31, 32 are employed per interconnect stage 3, the footprint FP is substantially a rectangular triangle with its hypotenuse HP extending as the longest boundary line along a diagonal between opposing edges of the stage's 3 real estate. In that case, the center corner and the distant corner DC are the endpoints of the hypotenuse HP. As is clear to anyone skilled in the art, the footprint FP may be shaped in conjunction with any test contact array pattern and its derived optimized real estate as well as any number of identical and/or non identical cantilevers 31, 32, 41, 42 employed within an interconnect stage 3.

The bases 301, 401 (see also FIGS. 8–11) are placed within the distal portion of the footprint FP and substantially coplanar with said footprint as the non release portion of the cantilevers 31, 32, 41, 42. In the case of the exemplary interconnect stage 3 with pair wise connected mirrored cantilever representations, the beam connect 3062 substantially coincides with the symmetry boundary SB of the footprint FP. The scope of the invention includes embodiments, in which combined cantilevers are other than mirrored representations of each other as may be well appreciated by anyone skilled in the art.

Also in the case of pair wise connected mirrored cantilever representations, the bending axes 308 of connected pairs of cantilevers 31, 32 are preferably collinear to avoid internal stress in the conductive structure as a potential result of the bending operation as may be well appreciated by anyone skilled in the art. In such case, a maximum bend axis distance BD is limited by its orientation along the symmetry boundary SB.

In the case of not connected cantilevers 31, 32 a modified bending axis 3082 may be oriented such that it is middle perpendicular to the contact tip 307 as shown in FIG. 7. As a result, the bend axis distance BD may be increased beyond the length of the symmetry boundary SB, which in turn reduces the bending angle BA for a defined tip height TH.

Figure 12:
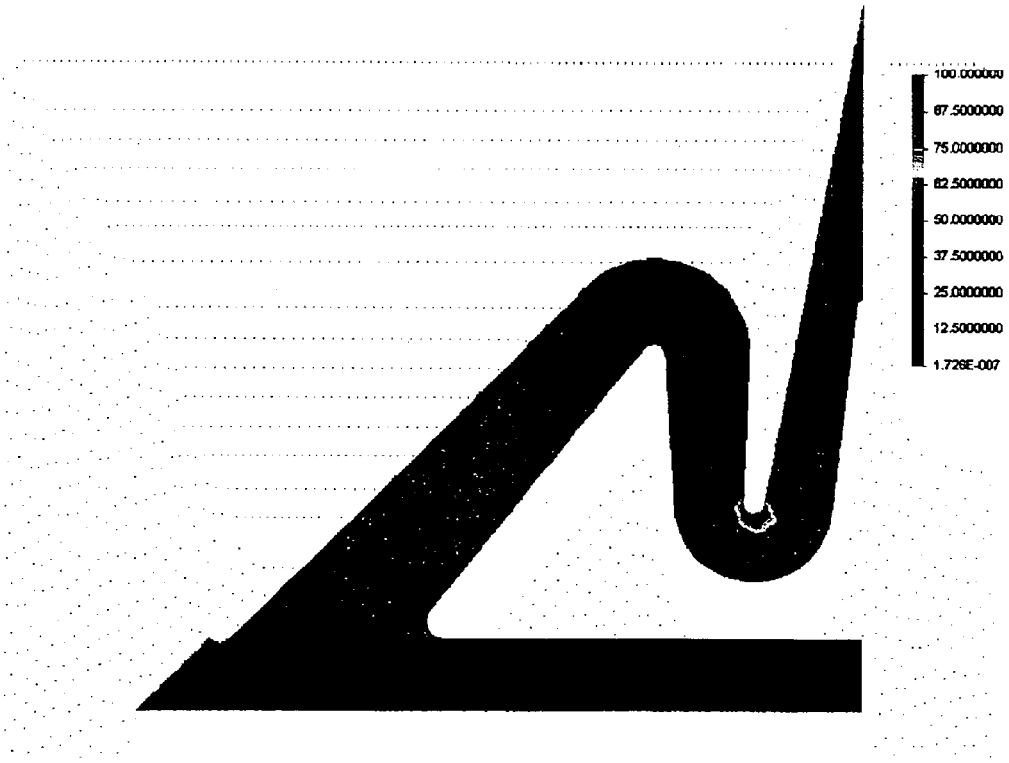
FIG. 12 shows a comparative stress analysis of the meander cantilever of FIG. 7 having a contact tip beam connected with an adjacent tip beam of a mirrored representation of the meander cantilever of FIG. 7.
Figure 13:
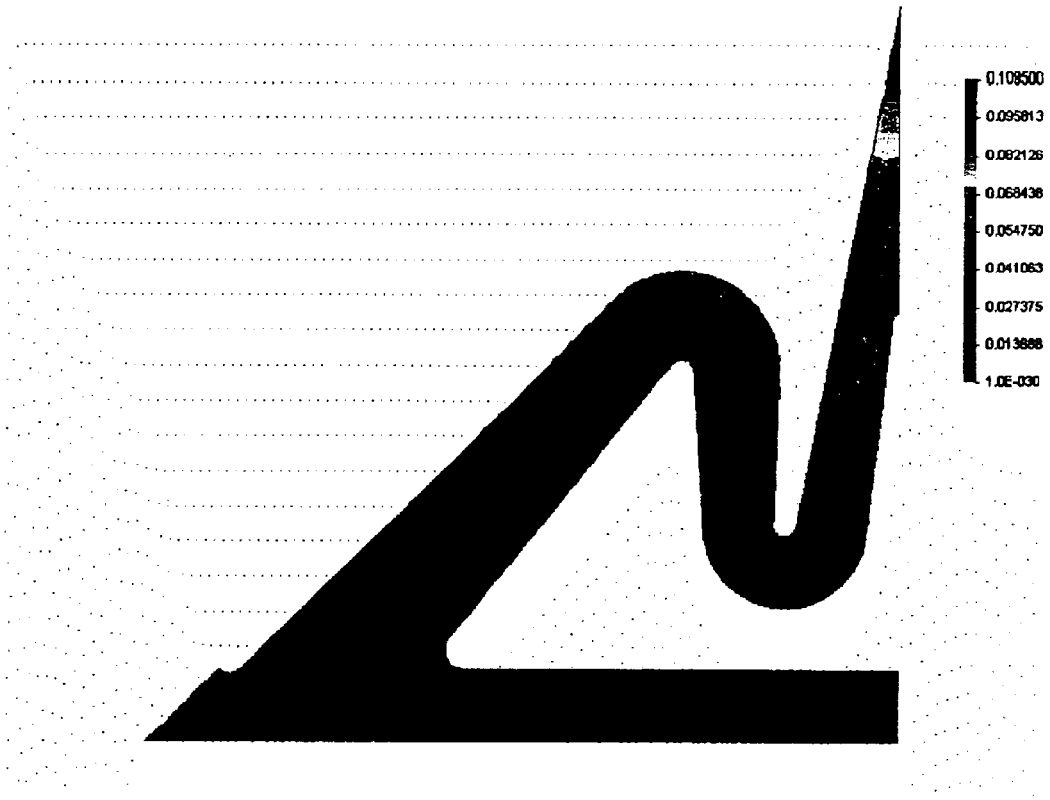
FIG. 13 shows a comparative displacement analysis of the meander cantilever of FIG. 7 having a contact tip beam connected with an adjacent tip beam of a mirrored representation of the meander cantilever of FIG. 7.

Comparative stress and displacement analyses of the cantilevers 31, 32 connected via beam connect 3062 is depicted in FIGS. 12, 13. For given material properties, a given tip contact force, and a given contour height, the cantilevers 31, 32 may experience a reference stress of close to 100% along an inner radius 3053 of the forward bow 305. Deflection of the contact tip 307 is about 109% of a reference displacement of 0.1. Stress gradients are at highest levels between inner radii 3031, 3051 and their respective outer radii 3033, 3053 as well as around the socket radius 3021.

Results of tested experimental interconnect stages similar to stage 3 with pair wise connected cantilevers 31, 32 were fabricated of Nickel Manganese for a pitch PX, PY of about 1.27 mm. The testing revealed an average contact force of 25 Grams at a total average deflection of both cantilevers 31, 32 of about 0.012" during 100,000 number of testing cycles.

Figure 14:
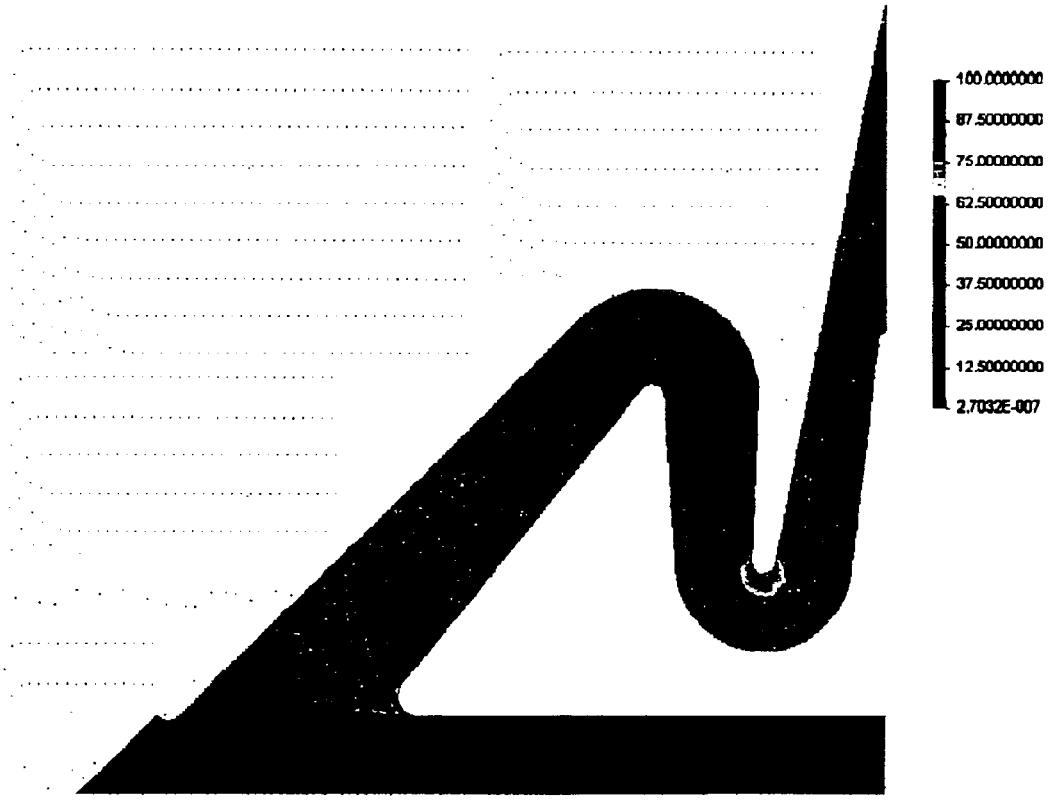
FIG. 14 shows a comparative stress analysis of the meander cantilever of FIG. 7 having a released tip beam.
Figure 15:
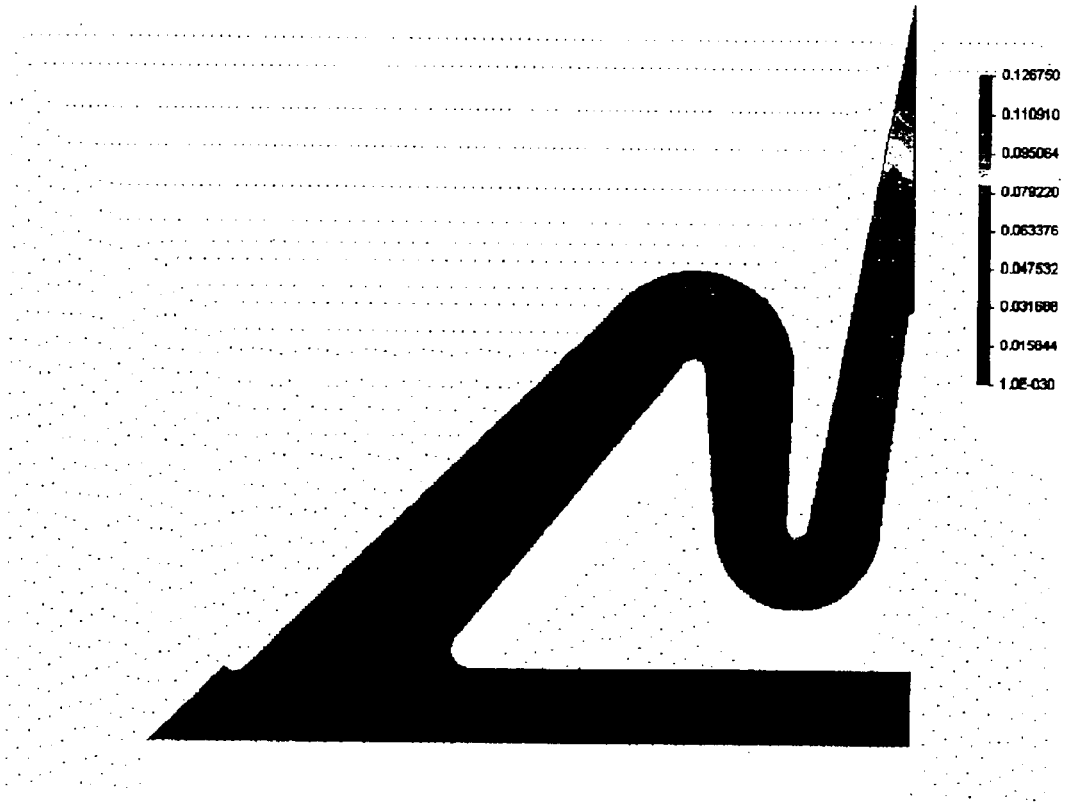
FIG. 15 shows a comparative displacement analysis of the meander cantilever of FIG. 7 having a released tip beam.

Comparative stress and displacement analyses of freely suspended cantilevers 31, 32 are depicted in FIGS. 14, 15. For the same analysis conditions as in FIGS. 12, 13, the cantilevers 31, 32 may experience a reference stress of similarly close to 100% along an inner radius 3053 of the forward bow 305. Deflection of the contact tip 307 is about 127% of a reference displacement 0.1. Bending axis 308 is applied in analyses of FIGS. 12–14. For a given cantilever contour, the displacement of freely suspended cantilevers 31, 32, 41, 42 is about 20% larger than tip connected cantilevers 31, 32, 41, 42 with similar stress distributions for both conditions.

The integration of at least two contact sets 30 introduces at least two completely separate conductive paths between the contacts 8, 9 within a single interconnect stage 3. Each contact set 30 established an independent conductive path across base connect 309, 409 (see also FIG. 9). As shown in FIG. 4, the absence of the base connect 309 establishes an insulation gap IG between adjacent bases 301 of separate contact sets 30. In case of beam connected cantilevers 31, 32, their respective bases 301 may be also conductively connected to provide current flow along both paired cantilevers 31, 32.

With increasing number of independent contacting paths the overall transmission resistance between opposing contacts 8, 9 becomes lower in accordance with the well known physical law that the reciprocal total resistance equals the sum of each of the conductive paths' reciprocal path resistance. In addition, multiple contacting path average fluctuations in the contact resistance between the individual contact tips 307 and their respective contacts 8, 9. The average overall contacting resistance of the tested experimental interconnect stages fluctuated of about 5% during above number of testing cycles.

According to FIGS. 8–11, a number of modifications may be introduced to cantilevers 31, 32, which are all together depicted in a modified cantilever 41/42. Teachings presented for cantilevers 31, 32 may be applied to the modified cantilever 41/42 and vice versa. The configurations and modifications of cantilevers 31, 32, 41, 42 may be optionally combined in fashion and number as appreciated by anyone skilled in the art.

The modified cantilever 41/42 corresponds in application substantially to cantilevers 31 and 32. A modified base 401 has a base extension 4015 extending along the base beam 402 towards the contact tip 407. In that fashion, the interface boundaries between the base 401 and the carrier structure 5 may be extended beyond a bending axis support 54 (see FIG. 11) reducing the risk of eventual well known delamination due to peak stresses in the interface boundaries. The base 401 has a reduced lateral extension giving way to an enlarged forward bow 405. The bending axis 4082 is middle perpendicular to the contact tip 407. The base beam 402 propagates towards the contact tip 407 with its lateral contours substantially symmetric to a base beam symmetry axis 4029, which in turn preferably coincides with the contact tip 407. In that fashion, the base beam 402 is substantially free of torque and sheer stress. As an additional favorable result, stress distributions along the bending axis 4082 are substantially equal and substantially free of stress gradients in the proximity of the socket radii 4021.

Figure 18:
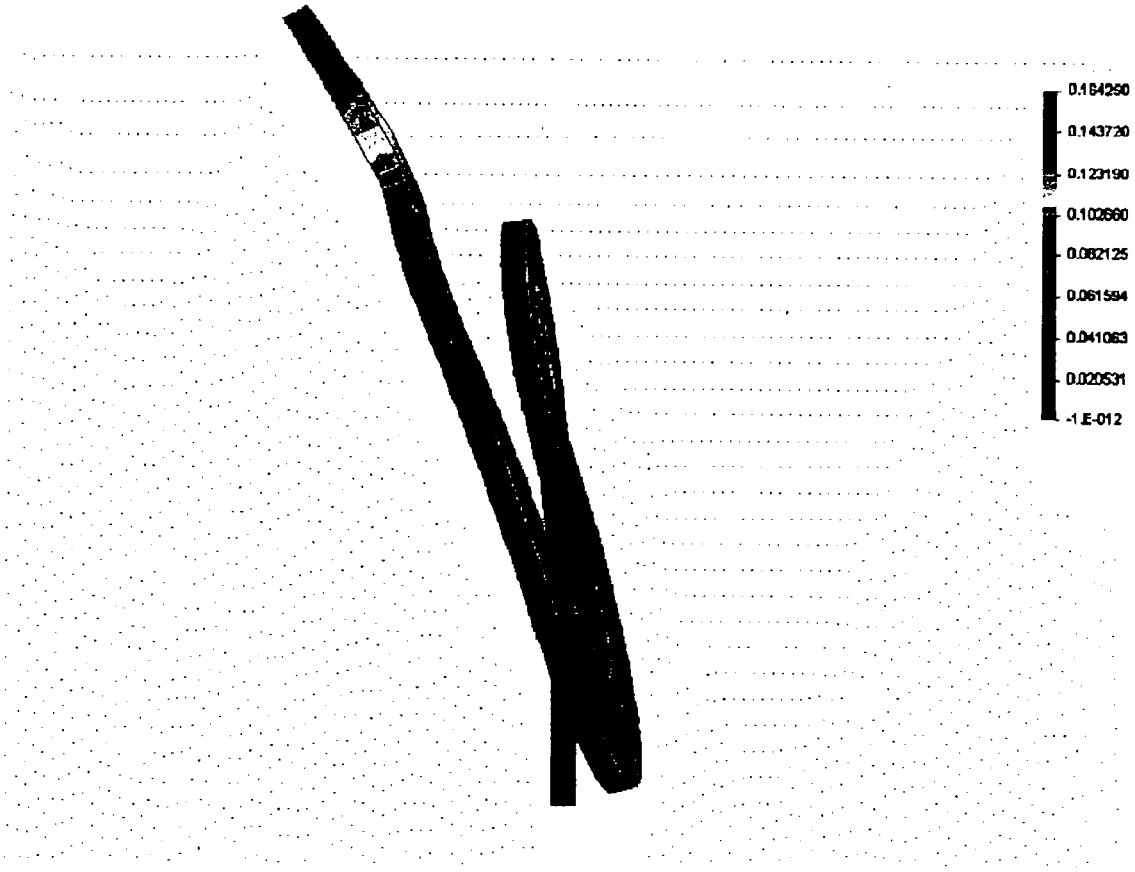
FIG. 18 is a scaled side view of the comparative displacement analysis of FIG. 17. Displacement is depicted off a vertical.

The base beam 402 is exposed to a major degree to a bending momentum resulting from the contacting force acting on the contacting tip 407. To a minor degree, the base beam 402 is also exposed to an opposite momentum applied at its end that is close to the contact tip 407. This is well visible in FIG. 18 depicting the scaled side view of a comparative displacement analysis computed with the same analysis conditions as in FIGS. 12, 13. An optimized base beam 402 has therefore side contours that are oriented in a slight outward offset to the contact tip 407. The base beam 402 may be extended such that sufficient area is available within the footprint FP for the reverting bow 403 adjacent the tip beam 406.

Radial stress gradient in the reverting bow 403 may be reduced by reducing the discrepancy between inner radius 4031 and the outer radius 4033. The same applies even more importantly to the forward bow 405 and its inner and outer radii 4051 and 4053. This is caused by the larger distance of the forward bow 405 to the contact tip 407 such that the torque experienced in the forward bow 405 between tip beam 406 and reverting beam 404 is substantially larger than the torque experienced by reverting bow 403. The meandering contour of the flexible cantilever portion advantageously utilizes the triangular foot print FP to provide the forward bow 405 with a maximum radius.

Figure 16:
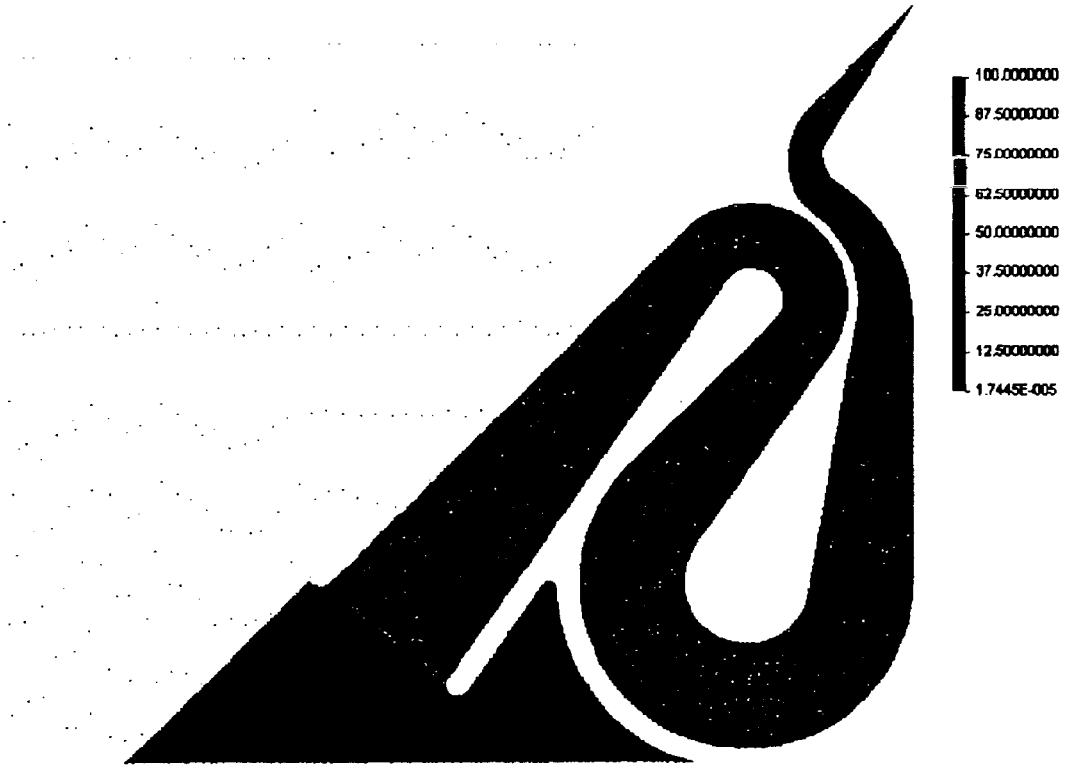
FIG. 16 shows a comparative stress analysis of the meander cantilever of FIG. 8 having a released tip beam.

Reducing the lateral extension of the base 401 additionally increases the area available for the forward bow 405. FIG. 16 shows a comparative stress analysis computed for the cantilever 41/42 with the same analysis conditions as in FIGS. 12, 13. The stress gradients in the bows 403, 405 are substantially reduced. The peak stress in the forward bow 405 is about 57% of the reverence maximum. In addition, the peak stress regions in the bows 403, 405 are in an offset to the contour boundaries which is a favorable condition for reducing fatigue cracking.

Reverting beam 304 is exposed to both bending and torsion.

Bending momentums are active at both ends. On one side this is due to the resilience of the base beam 402 and the reverting bow 403. On the other side this is due to a momentum resulting from the contact force via the tip beam 406 and the forward bow 405. Torsion momentums apply in similar fashion. Both bending and torsion momentums counteract resulting in a pivoting of the reverting beam 404, which is reflected in FIGS. 17, 18 as a zero displacement. FIG. 18 shows that the deformation resulting from the torsion is at relatively low levels compared to the bending deformation. Stress and displacement analyses of FIGS. 12–18 are computed on planar reference objects. The displacement visible in FIG. 18 is therefore a displacement off the vertical orientation.

The tip beam 406 is at least in the vicinity of the forward bow 405 symmetrically profiled with respect to the symmetry line 4069, which coincides with the contact tip 407. In addition, the width of the tip beam 406 preferably changes in proportion with the distance to the contact tip 407 irrespective of optional secondary meandering bends 4063, 4064 and optional offset tip beam portion 4065.

Figure 8:
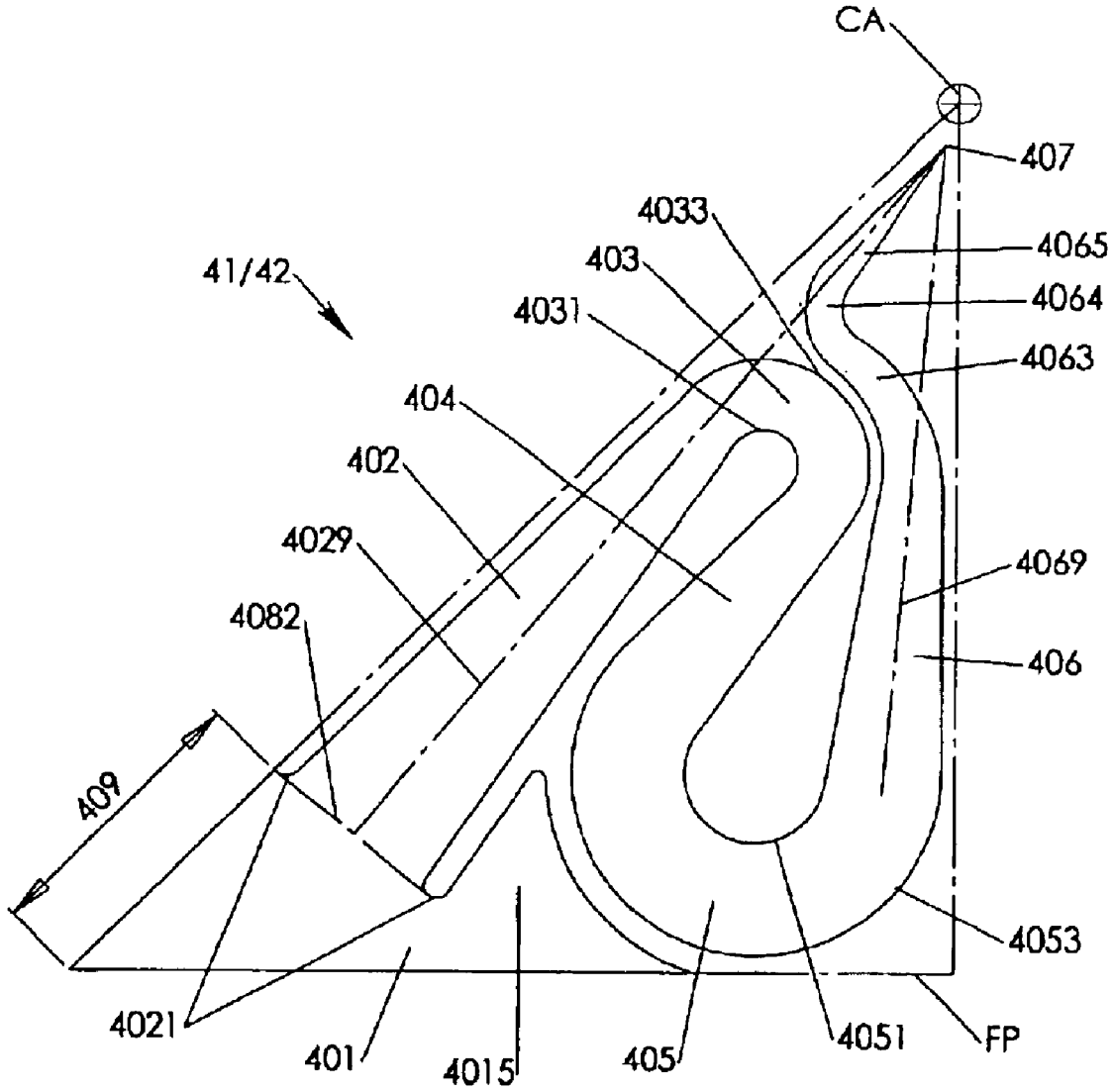
FIG. 8 depicts a modified meander cantilever in flattened condition.
Figure 9:
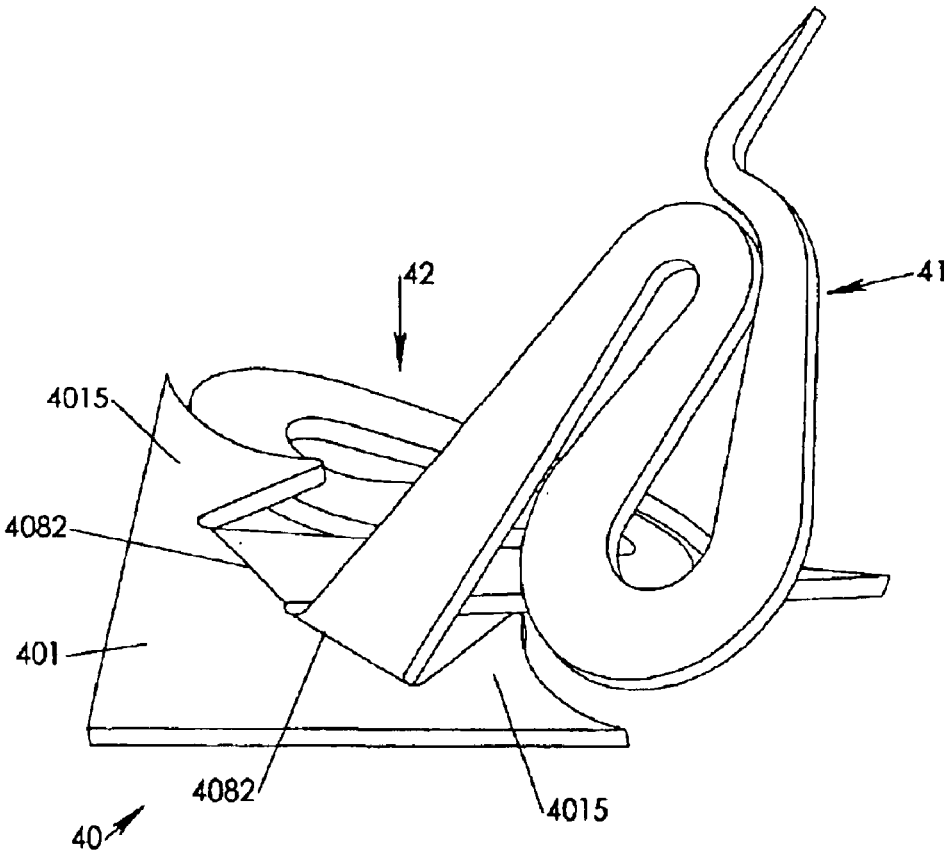
FIG. 9 depicts a modified contact set including an upward and a downward bent meander cantilever of FIG. 8.
Figure 10:
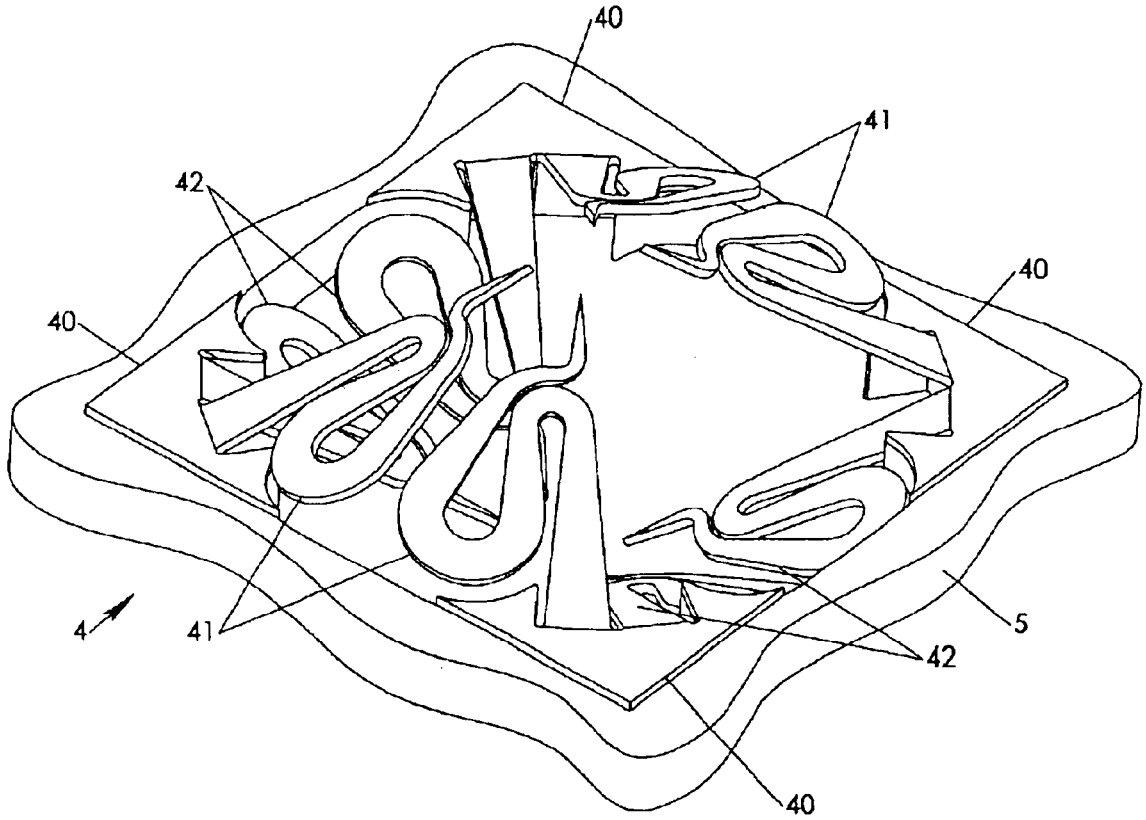
FIG. 10 is a top perspective view of a interconnect stage in accordance with a second embodiment of the present invention including a number of modified contact sets of FIG. 9.
Figure 11:
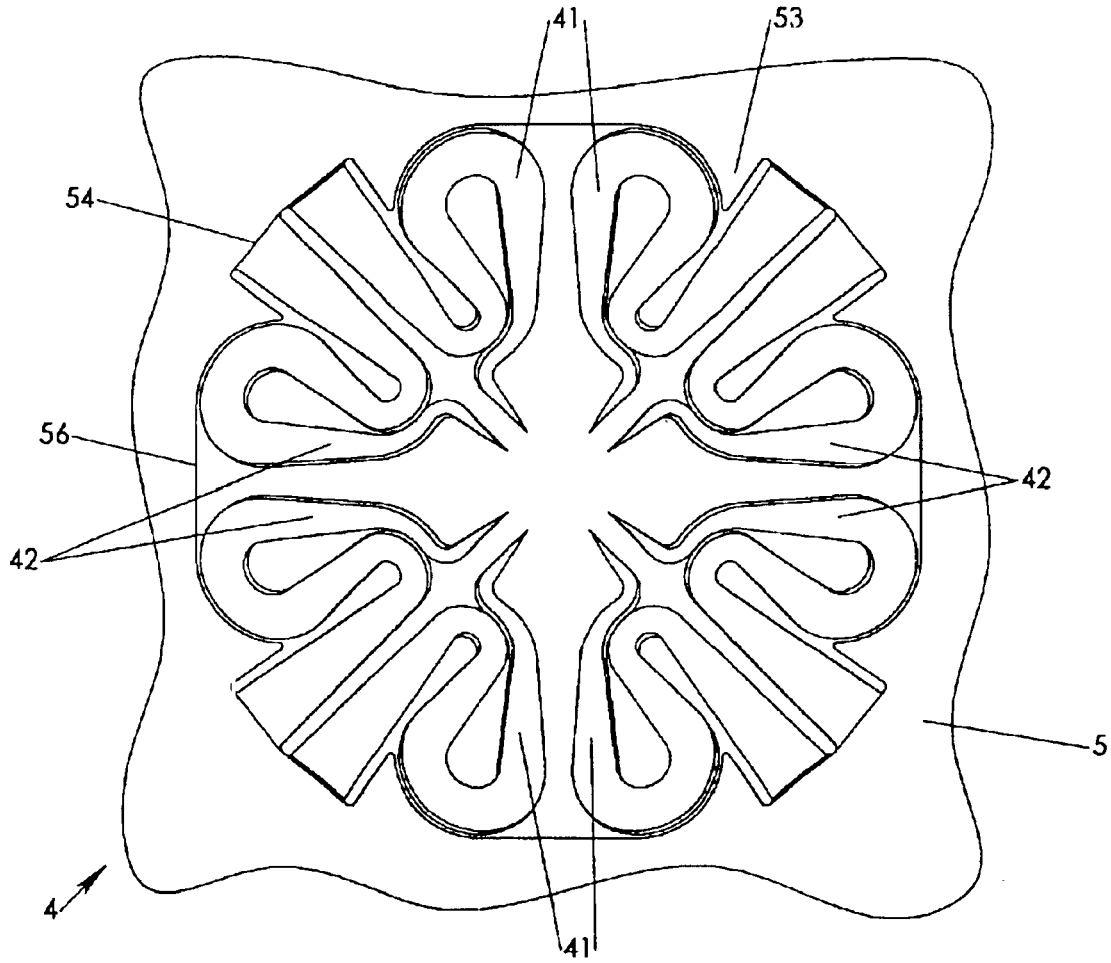
FIG. 11 is a bottom view of the interconnect stage of FIG. 10.

The individual elements of the cantilevers 31, 32, 41, 42 are preferably fabricated in planar condition as shown in FIGS. 7, 8. Separation of the individual elements is warranted by including minimum gaps between adjacent structures. As a result, the contacting tips 307, 407 are in a slight offset to the contacting axis CA. This offset increased during the bending operation. This tip offset may be advantageously utilized in combination with the offset tip beam portion 4065 for an improved centering action of concurrently contacting cantilevers 41 and 42. This may be of particular value where at least one of the contacts 8, 9 is spherically shaped.

A modified carrier structure 5 may feature separately configured base extension supports 53 for supporting the base extensions 4015. In addition, the modified carrier structure 5 may feature cantilever releases 56 for a collision free deflection of the cantilevers 42.

Contact set 30 preferably includes two combined cantilever pairs with a total of four cantilevers 31, 32. The contact set 40 includes preferably two cantilevers 41, 42. In both contact sets 30, 40 the downward oriented cantilevers 32, 42 are rotated representations of the upwards oriented cantilevers 31, 41 rotated around a boundary edge of the footprint FP and vice versa. The preferred boundary edge for rotating the rotated representations is the longest edge of the footprint FP, which in case of a rectangular footprint FP is the hypotenuse HP. The rotated representations are placed within the real estate, such that that their respective bases are immediately adjacent and conductively connected via the base connect 309, 409 (see also FIG. 8) and such that their respective contact tips 307, 407 are within a similar offset to said contacting axis CA.

Up- and downward cantilevers 31, 41 and 32, 42 are combined at their respective bases 301, 401 via the base connects 309, 409. The interconnect 3 features two completely independent conductive paths and the interconnect 4 features four completely independent conductive paths. The combination of cantilevers 31, 32 and 41, 42 as rotated representations of each other provides for a balanced contacting of contacts 8, 9 with a minimum of deviation momentums eventually forcing the contact tips 307, 407 laterally away from the contacting axis CA. As a result, the cantilevers 31, 32, 41, 42 may be shaped with reduced stiffness which is favorable for reducing an overall contact force of a tested chip having a large number of contacts 8.

Cantilevers 41 are circumferentially arranged around the contacting axis CA preferably in mirrored configuration to minimize eventual external torque around the contacting axis CA resulting from the deflection of the cantilevers during impact of contacts 9. Likewise, cantilevers 42 are circumferentially arranged around the contacting axis CA also preferably in mirrored configuration to minimize eventual external torque around the contacting axis resulting from the deflection of the cantilevers during impact of contact 8. Regardless this preference, the scope of the invention is not limited to a particular arrangement of the cantilevers 31, 41, 32, 42 within an interconnect stage 3, 4 and within the breath of the teachings presented above.

Figure 17:
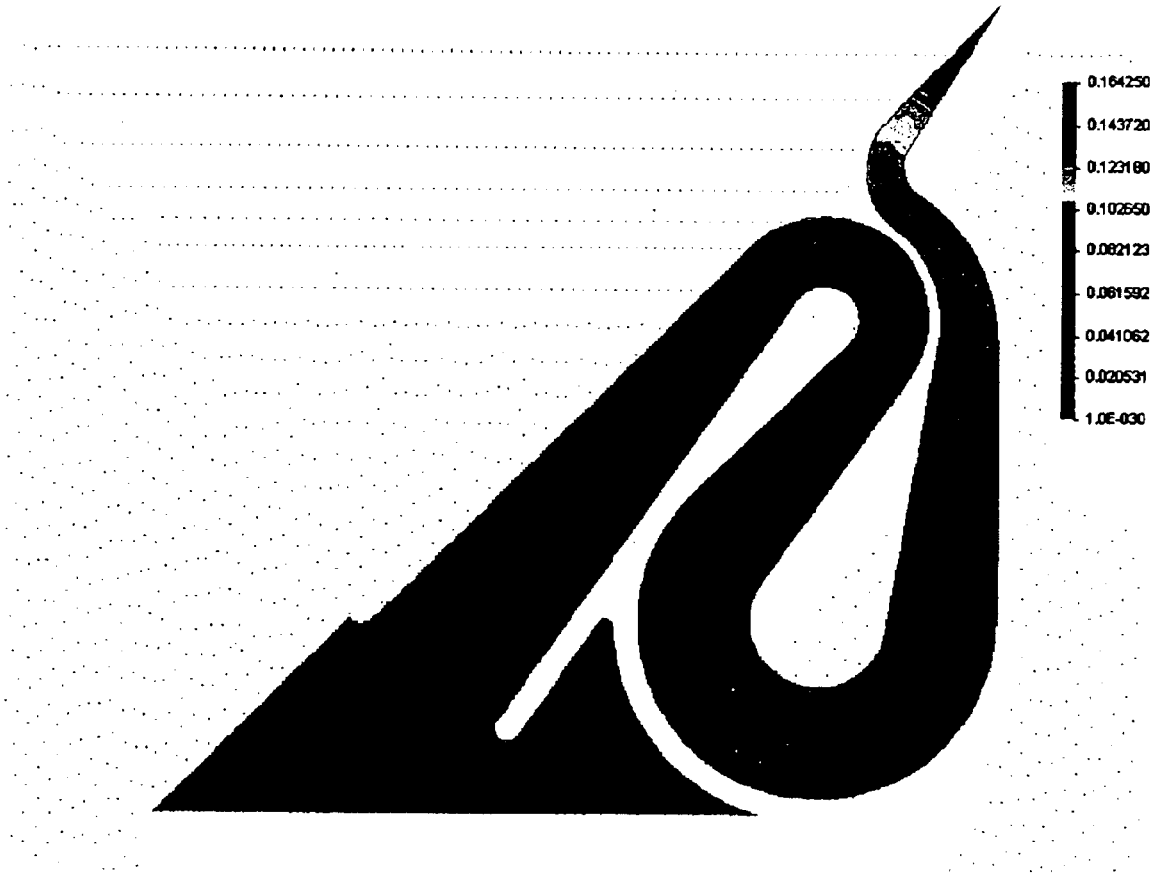
FIG. 17 shows a comparative displacement analysis of the meander cantilever of FIG. 8 having a released tip beam.

The individual modifications taken together result in highly uniform stress distributions of the released portion of the cantilever 41, 42 including low stress peaks, shallow stress gradients and improved tip displacement. As depicted in FIGS. 16, 17, 18, the overall peak stress is about 57% of the reference maximum and the displacement of the contact tip 407 is about 164% of the reference displacement.

The scope of the invention includes embodiments in which contact sets 30, 40 are separately fabricated and combined with the carrier structures 2, 5 in a final operation.

The scope of the invention includes embodiments in which a cantilever contact 31, 41 may be utilized to establish contact between contact 8 and any other well known contact or conductive lead directly temporarily or permanently connected to base 301, 401. Likewise, the scope of the invention includes embodiments in which a cantilever contact 32, 42 may be utilized to establish contact between contact 9 and any other well known contact or conductive lead directly temporarily or permanently connected to base 301, 401.

The scope of the invention includes embodiments in which one ore both of contacts 31, 41 and 32, 42 are executed without reverting bow 303, 403, reverting beam 304, 404, forward bow 305, 405 and without tip beam 306, 406. In such embodiments, the base beam 302, 402 extends to and terminates in the contact tip 307, 407. Also in such embodiments, the beam connect 3062 connects mirrored representations of base beam 306, 406.

Accordingly, the scope of the invention described in the above specification is set forth by the following claims and their legal equivalents.

What is claimed is:

1. A meandering cantilever contact comprising:

a. a triangular footprint having a center corner coinciding with a contacting axis along which a test contact is contacting said cantilever contact;

b. a contact tip proximal to said contacting axis for contacting said test contact;

c. a base mechanically connecting said cantilever contact to a carrier structure, said base being placed within a distal portion of said footprint and substantially coplanar with said footprint, said distal portion being distal to said contacting axis;

d. a base beam extending from said base towards said contact tip;

e. a reverting bow at an end of said base beam that is close to said contact tip;

f. a reverting beam extending from said reverting bow away from said contact tip;

g. a forward bow at an end of said reverting beam that is distal to said contact tip;

h. a tip beam extending from said forward bow towards said contact tip, said tip beam terminating in said contact tip.

2. The cantilever contact of claim 1, wherein said base beam is bent with respect to said base along a bending axis such that said contact tip is in a tip height above said footprint.

3. The cantilever contact of claim 2, wherein said bending axis is substantially middle perpendicular to said contact tip.

4. The cantilever contact of claim 1, wherein said footprint is a substantially rectangular triangle, and wherein said center corner is a hypotenuse end point of said footprint.

5. The cantilever contact of claim 1, wherein said base is placed in a distant corner of said footprint, said distant corner being most distant to said center corner.

6. The cantilever contact of claim 1, wherein said base further comprises a base extension extending along said base beam towards said contacting axis.

7. The cantilever contact of claim 1, wherein said tip beam is connected to a mirrored representation of said cantilever contact along a tip beam connect, said tip beam connect is substantially coincident with a symmetry boundary of said footprint, said mirrored representation being mirrored from said cantilever contact along said symmetry boundary.

8. A contact set for conductively contacting two opposing contacts substantially along a contacting axis in a substantially balanced fashion with respect to said contact axis, said contact set comprising at least one upwards pointing contact and at least one downwards pointing contact, both contacts being conductively connected to each other via a base connect establishing an independent conductive path between said opposing contacts, wherein at least one of said upwards and said downwards pointing contacts is a meandering cantilever contact having:

a. a triangular footprint having a center corner coinciding with said contacting axis;

b. a contact tip proximal to said contacting axis for contacting one of said two opposing contacts;

c. a base mechanically connecting said cantilever contact to a carrier structure, said base being placed within a distal portion of said footprint and substantially coplanar with said footprint, said distal portion being distal to said contacting axis;

d. a base beam extending from said base towards said contact tip;

e. a reverting bow at an end of said base beam that is close to said contact tip;

f. a reverting beam extending from said reverting bow away from said contact tip;

g. a forward bow at an end of said reverting beam that is distal to said contact tip;

h. a tip beam extending from said forward bow towards said contact tip, said tip beam terminating in said contact tip.

9. The contact set of claim 8, wherein said footprint is a substantially rectangular triangle, and wherein said center corner is a hypotenuse end point of said footprint.

10. The contact set of claim 8, wherein said base is placed in a most distant corner of said footprint, said most distant corner being most distant to said center corner.

11. The contact set of claim 8, wherein said base further comprises a base extension extending along said base beam towards said contacting axis.

12. The contact set of claim 8, wherein said tip beam is connected to a mirrored representation of said cantilever contact along a tip beam connect, said tip beam connect is substantially coincident with a symmetry boundary along which said mirrored representation is mirrored from said cantilever contact.

13. The contact set of claim 8 being part of a multiple conductive path interconnect stage having multiple representations of said contact set arrayed in a circular fashion around said contacting axis.

14. The contact set of claim 8 being part of a multiple conductive path interconnect stage having multiple representations of said contact set arrayed in a mirrored fashion around said contacting axis.

15. The contact set of claim 8, wherein said base beam is bent with respect to said base along a bending axis such that said contact tip is in a tip height above said footprint.

16. The contact set of claim 15, wherein said bending axis is substantially middle perpendicular to said contact tip.

17. The contact set of claim 8, wherein at least one other of said upwards and downwards pointing contacts is said meandering cantilever contact.

18. The contact set of claim 17, wherein said one other meandering cantilever contact is a rotated representation of said meandering cantilever contact rotated around a boundary edge of said footprint and arranged adjacent to said meandering cantilever, wherein at least one of their respective bases are immediately adjacent and conductively connected via said base connect and such that the respective contact tips of all of said meandering cantilevers are within a similar offset to said contacting axis.

19. The contact set of claim 18, wherein a second base beam of said rotated representation is bent with respect to said second base along a second bending axis of said mirrored representation such that a second contact tip of said mirrored representation is in a tip height below said footprint and proximal to said contacting axis.

20. The contact set of claim 18, wherein said boundary edge is the longest edge of said footprint.

21. The contact set of claim 20, wherein said footprint is a rectangular triangle and wherein said longest boundary edge is a hypotenuse of said footprint.

22. An interconnect assembly for conductively contacting opposing contacts substantially along their respective contacting axes, said interconnect assembly comprising:

a. a carrier structure for being placed in between said opposing contacts, said carrier structure having a top face and at least one opening substantially concentric to at least one of said contacting axes;

b. at least one multipath interconnect stage comprising at least two of said two contact sets being configured for conductively contacting two opposing contacts substantially along a contacting axis in a substantially balanced fashion with respect to said at least one of said contact axes, said contact set comprising at least one upwards pointing contact and at least one downwards pointing contact, said upwards and downwards pointing contacts being conductively connected to each other via a base connect establishing an independent conductive path between said opposing contacts, wherein at least one of said upwards and said downwards pointing contacts is a meandering cantilever contact having:

i. a triangular footprint having a center corner coinciding with said contacting axis;

ii. a contact tip proximal to said contacting axis for contacting one of said two opposing contacts;

iii. a base mechanically connecting said cantilever contact to a carrier structure, said base being placed within a distal portion of said footprint and substantially coplanar with said footprint, said distal portion being distal to said contacting axis;

iv. a base beam extending from said base towards said contact tip;

v. a reverting bow at an end of said base beam that is close to said contact tip;

vi. a reverting beam extending from said reverting bow away from said contact tip;

vii. a forward bow at an end of said reverting beam that is distal to said contact tip;

iix. a tip beam extending from said forward bow towards said contact tip, said tip beam terminating in said contact tip.

23. The interconnect assembly of claim 22, wherein said footprint is a substantially rectangular triangle, and wherein said center corner is a hypotenuse end point of said footprint.

24. The interconnect assembly of claim 22, wherein said base is placed in a most distant corner of said footprint, said most distant corner being most distant to said center corner.

25. The interconnect assembly of claim 22, wherein said base further comprises a base extension extending along said base beam towards said contacting axis.

26. The interconnect assembly of claim 22, wherein said tip beam is connected to a mirrored representation of said cantilever contact along a tip beam connect, said tip beam connect is substantially coincident with a symmetry boundary along which said mirrored representation is mirrored from said cantilever contact.

27. The interconnect assembly of claim 22 being part of a test apparatus for repetitively receiving and testing circuit chips, wherein one of said opposing contacts is part of said test apparatus and the remaining of said opposing contacts is part of said circuit chip.

28. The interconnect assembly of claim 22, wherein said base beam is bent with respect to said base along a bending axis such that said contact tip is in a tip height above said footprint.

29. The interconnect assembly of claim 28, wherein said bending axis is substantially middle perpendicular to said contact tip.

30. The interconnect assembly of claim 22, wherein at least one other of said upwards and downwards pointing contacts is said meandering cantilever contact.

31. The interconnect assembly of claim 30, wherein said one other meandering cantilever contact is a rotated representation of said meandering cantilever contact rotated around a boundary edge of said footprint and arranged adjacent to said meandering cantilever, wherein at least one their respective bases are immediately adjacent and conductively connected via said base connect and such that the respective contact tips of all of said meandering cantilevers are within a similar offset to said contacting axis.

32. The interconnect assembly of claim 31, wherein a second base beam of said rotated representation is bent with respect to said second base along a second bending axis of said mirrored representation such that a second contact tip of said mirrored representation is in a tip height below said footprint and proximal to said contacting axis.

33. The interconnect assembly of claim 31, wherein said boundary edge is the longest edge of said footprint.

34. The interconnect assembly of claim 33, wherein said footprint is a rectangular triangle and wherein said longest boundary edge is a hypotenuse of said footprint.

35. A contact set for conductively contacting two opposing contacts substantially along a contacting axis in a substantially balanced fashion with respect to said contact axis, said contact set comprising at least one upwards pointing contact and at least one downwards pointing contact, both contacts being conductively connected to each other via a base connect establishing an independent conductive path between said opposing contacts, wherein at least one of said upwards and said downwards pointing contacts includes:

a. a triangular footprint having a center corner coinciding with said contacting axis;

b. a contact tip proximal to said contacting axis for contacting one of said two opposing contacts;

c. a base mechanically connecting said contact to a carrier structure, said base being placed within a distal portion of said footprint and substantially coplanar with said footprint, said distal portion being distal to said contacting axis; and d. a base beam extending from said base towards to and terminating in said contact tip.

36. The contact set of claim 35, wherein said footprint is a substantially rectangular triangle, and wherein said center corner is a hypotenuse end point of said footprint.

37. The contact set of claim 35, wherein said base is placed in a most distant corner of said footprint, said most distant corner being most distant to said center corner.

38. The contact set of claim 35, wherein said base further comprises a base extension extending along said base beam towards said contacting axis.

39. The contact set of claim 35 being part of a multiple conductive path interconnect stage having multiple representations of said contact set arrayed in a circular fashion around said contacting axis.

40. The contact set of claim 35 being part of a multiple conductive path interconnect stage having multiple representations of said contact set arrayed in a mirrored fashion around said contacting axis.

41. The contact set of claim 35, wherein said base beam is bent with respect to said base along a bending axis such that said contact tip is in a tip height above said footprint.

42. The contact set of claim 41, wherein said bending axis is substantially middle perpendicular to said contact tip.

43. The contact set of claim 35, wherein at least one of said base beam is connected to a mirrored representation of at least one of said contact along a beam connect, said beam connect is substantially coincident with a symmetry boundary along which said mirrored representation is mirrored from said cantilever contact.

44. The contact set of claim 43, wherein respective bending axes of said contact and said mirrored representation are substantially middle perpendicular to their common contact tip and in an angle to each other.

45. The contact set of claim 35, wherein said interconnect stage is part of a test apparatus for repetitively receiving and testing circuit chips, wherein one of said opposing contacts is part of said test apparatus and the remaining of said opposing contacts is part of said circuit chip.

46. The contact set of claim 46, wherein said interconnect stage is part of a test apparatus for repetitively receiving and testing circuit chips, wherein one of said opposing contacts is part of said test apparatus and the remaining of said opposing contacts is part of said circuit chip.

47. The contact set of claim 35, wherein said upwards and said downwards pointing contacts are rotated representations of each other rotated around a boundary edge of said footprint and arranged adjacent to each other, wherein at least one of their respective bases are immediately adjacent and conductively connected via said base connect and such that the respective contact tips of all of said contacts are within a similar offset to said contacting axis.

48. The contact set of claim 47, wherein a second base beam of said rotated representation is bent with respect to said second base along a second bending axis of said mirrored representation such that a second contact tip of said mirrored representation is in a tip height below said footprint and proximal to said contacting axis.

49. The contact set of claim 47, wherein said boundary edge is the longest edge of said footprint.

50. The contact set of claim 49, wherein said footprint is a rectangular triangle and wherein said longest boundary edge is a hypotenuse of said footprint.

* * * * *